US011009259B2

(12) United States Patent
Shah et al.

(10) Patent No.: US 11,009,259 B2
(45) Date of Patent: May 18, 2021

(54) LOW WATER MECHANICAL CSD-1 MANUAL SWITCH CONVERSION TO ELECTRO-MECHANICAL SWITCH

(71) Applicant: FLUID HANDLING LLC., Morton Grove, IL (US)

(72) Inventors: Pratik Naresh Shah, Des Plaines, IL (US); Ronan Stephens, Chicago, IL (US); James J. Gu, Buffalo Grove, IL (US)

(73) Assignee: FLUID HANDLING LLC, Morton Grove, IL (US)

( * ) Notice: Subject to any disclaimer, the term of this patent is extended or adjusted under 35 U.S.C. 154(b) by 666 days.

(21) Appl. No.: 15/815,103

(22) Filed: Nov. 16, 2017

(65) Prior Publication Data

US 2018/0283733 A1 Oct. 4, 2018

Related U.S. Application Data

(60) Provisional application No. 62/422,802, filed on Nov. 16, 2016.

(51) Int. Cl.
*F24H 9/20* (2006.01)
*H05B 1/02* (2006.01)

(52) U.S. Cl.
CPC ..... *F24H 9/2021* (2013.01); *H05B 1/0227* (2013.01); *F24D 2220/048* (2013.01)

(58) Field of Classification Search
CPC .... F24H 9/20; F24H 9/2092; F24D 2220/048; H05B 1/02; H05B 1/0277
See application file for complete search history.

(56) References Cited

U.S. PATENT DOCUMENTS 3,190,268 A 6/1965 MacDonald et al.
3,776,200 A 12/1973 Tine et al.
(Continued)

FOREIGN PATENT DOCUMENTS

CA 2867607 A1 4/2016
WO 2014158731 A1 10/2014

OTHER PUBLICATIONS

Taco, Instruction Sheet Foam Compensating Low Water Cutoff withTest Button and DualVision™ Technology, pp. 1-4 (Year: 2008).*

(Continued)

*Primary Examiner* — Daniell L Negron
(74) *Attorney, Agent, or Firm* — Ware, Fressola, Maguire & Barber LLP

(57) ABSTRACT

A switch assembly features an automatic switch and an electronic circuit board. The automatic switch has a common contact and a normally open switch contact to short when a boiler has sufficient water, and has the common contact and a normally closed switch contact to short when the boiler has a low water level. The electronic circuit board has a signal processor, a reset switch, and a low water status LED for providing a status indication of a low water condition that remains ON even if the water level has risen unless the reset switch is reset. The signal processor couples to the common contact, the normally closed switch contact and the normally open switch contact, senses signaling containing the status of the common contact, the normally closed switch contact and the normally open switch contact, provides corresponding signaling to turn ON the low water status LED when the water level is low, and responds to a reset switch signal and turn OFF the low water status LED.

11 Claims, 2 Drawing Sheets

(56) References Cited

U.S. PATENT DOCUMENTS

| | | | | |
|---|---|---|---|---|
| 3,834,357 | A | 9/1974 | Kaczmarek et al. | |
| 4,383,544 | A | 5/1983 | Vosper | |
| 4,465,088 | A | 8/1984 | Vosper | |
| 4,565,930 | A | 1/1986 | Bartels | |
| 4,567,557 | A | 1/1986 | Burns | |
| 4,662,390 | A | 5/1987 | Hawkins | |
| 4,844,335 | A | 7/1989 | McKinley et al. | |
| 5,012,429 | A | 4/1991 | Lantz | |
| 5,184,472 | A | 2/1993 | Guilbault et al. | |
| 5,224,445 | A | 7/1993 | Gilbert, Sr. | |
| 5,600,997 | A | 2/1997 | Kemp et al. | |
| 6,520,122 | B2 | 2/2003 | Kemp et al. | |
| 6,666,086 | B2 | 12/2003 | Colman et al. | |
| 6,880,397 | B2 | 4/2005 | Thomson | |
| 7,032,542 | B2 | 4/2006 | Donnelly et al. | |
| 7,243,540 | B2 | 7/2007 | Merwin | |
| 7,317,993 | B2 * | 1/2008 | Merwin | G01F 23/0061 702/55 |
| 7,409,301 | B2 | 8/2008 | Tynkov | |
| 7,706,989 | B2 | 4/2010 | Merwin et al. | |
| 8,515,584 | B2 | 8/2013 | Miller et al. | |
| 9,435,565 | B2 | 9/2016 | Caves et al. | |
| 2013/0181630 | A1 | 7/2013 | Taipale et al. | |
| 2015/0226460 | A1 | 8/2015 | Zemach | |

OTHER PUBLICATIONS

"Electronic controls: Low water cutoff," Brochure, Taco, Inc., taco-hvac.com, Jan. 28, 2010. https://www.taco-hvac.com/uploads/FileLibrary/100-8.1.pdf.

"PSE-800-M Manual Reset LWCO for Steam Boilers," McDonnell & Miller brochure, statesupply.com, Jun. 2014. https://media.statesupply.com/filemanager/1/5/15012015-mcdonnell-miller_pse-800-m-manual-reset-lwco_brochure.pdf.

Holohan, D., "Why your boiler needs a low-water cutoff," Systems Help Center, 2014. https://heatinghelp.com/systems-help-center/why-your-boiler-needs-a-low-water-cutoff/

* cited by examiner

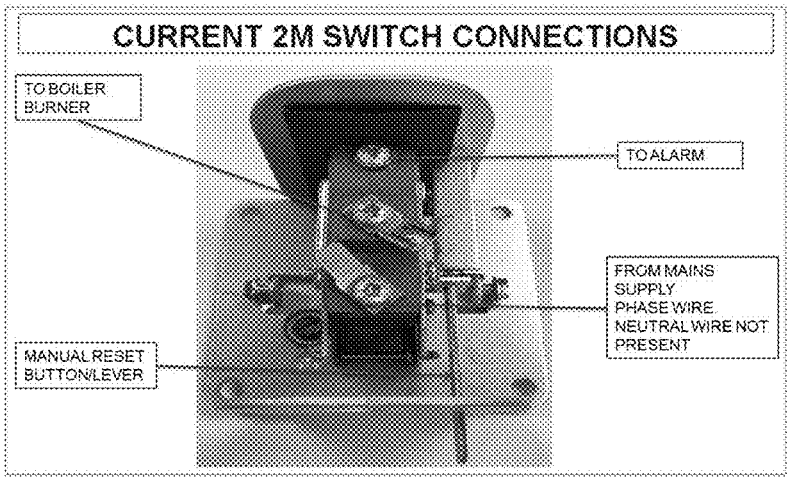
Figure-1: 2M (Manual) SWITCH
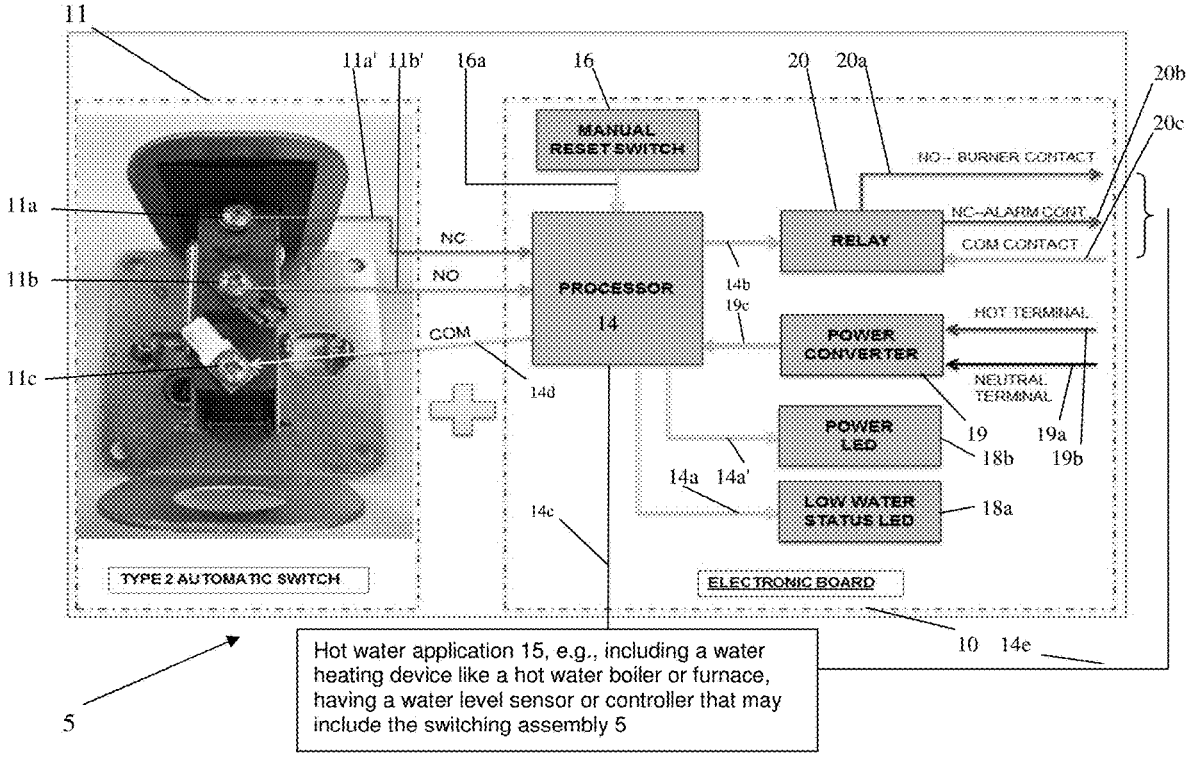
Figure-2: E-2M System Block Diagram

| | | | AUTOMATIC 2 SWITCH | | | RELAY CONTACTS | | LED STATUS | |
|---|---|---|---|---|---|---|---|---|---|
| TESTING FUNCTION | POWER | WATER CONDITION | NO Contact | NC Contact | MANUAL RESET BUTTON | BURNER CONTACTS | ALARM/FEEDER CONTACT | RED LED | GREEN LED |
| FUNCTIONAL | ON | INWATER | SHORT | OPEN | OFF | CLOSE | OPEN | DOM of 3 Secs and OFF | ON |
| | ON | OUTWATER | OPEN | SHORT | OFF | OPEN | CLOSE | DOB of 5 Secs and ON | ON |
| CSD COMPLIANCES | OFF | OUTWATER | OPEN | SHORT | OFF | OPEN | CLOSE | OFF | OFF |
| | ON | INWATER | SHORT | OPEN | OFF | OPEN | CLOSE | ON | ON |
| | ON | INWATER | SHORT | OPEN | PRESS AND RELEASE | CLOSE | OPEN | DOM of 3 Secs and OFF | ON |

Figure-3: E-2M FUNCTIONALITY TABLE

LOW WATER MECHANICAL CSD-1 MANUAL SWITCH CONVERSION TO ELECTRO-MECHANICAL SWITCH

CROSS-REFERENCE TO RELATED APPLICATION

This application claims benefit to provisional patent application Ser. No. 62/422,802, filed 16 Nov. 2016, which is hereby incorporated by reference in its entirety.

BACKGROUND OF THE INVENTION

1. Field of the Invention

The present invention relates to a switch; and more particularly to a switch for providing a mechanical low water cut-off (LWCO), e.g., for a burner or other hot water/liquid heating device.

2. Brief Description of Related Art

The mechanical manual switch is single pole double through (SPDT) type with a latching mechanism used in a Mechanical Low Water Cut-off (LWCO). At a normal water level, a circuit is closed. It latches open in a low water condition. Depressing the manual reset button unlatches the mechanism after the normal water level has been restored to the control.

This method of operation meets the requirements of ASME CSD-1, wherein if a LWCO is in a low water condition when there is an interruption of power, the LWCO will remain in a low water condition when power is restored regardless of water level. The manual reset button/lever needs to be pressed when the water level is restored to the normal water level in order to close the circuit.

Such a mechanical manual switch is manufactured at a low quantity, is very labor intensive to manufacture, has a low production yield rate, and consequently has a high cost to manufacture.

There are mechanical automatic switches that contains single pole double throw (SPDT) contacts to control a water feeder or alarm circuit and the low water cut-off. The low water cut-off switch control opens and closes based on water level. The water feeder or low water alarm circuit switch control works opposite to the LWCO control. Such switches are an automatic switch and therefore are not ASME CSD-1 compliant.

An automatic switch may be manufactured at high quantities and consequently at a more favorable cost. However, the key problem known in the art was how to provide the functionality of the manual switch by converting the automatic switch, e.g., without altering the design of the automatic switch and keeping same manual functionality.

SUMMARY OF THE INVENTION

In summary, the present invention provides a solution to this problem in the art, e.g., by providing a new version of a mechanical manual switch, herein called an "E-manual switch", that shall be backward compatible with the current manual switches, and also have the advantage of providing the option to users/customers of converting an automatic LWCO (using an automatic switch) to a CSD-1 complaint LWCO by adding the "E-manual switch" components.

The E-manual switch is a combination of an automatic type mechanical switch and a new electronic board. The E-manual switch according to the present invention may include a visual indication for the power and a low water control status.

Automatic Switch

In operation, the automatic type switch contacts will be controlled through the boiler water level. The mechanical automatic switch will switch its contacts depending on water level. When a water heating device, such as a boiler, has sufficient water, the automatic type switch will short its common and normally open contacts. When the water level is low, the automatic type switch will short common and normally close contacts. The new electronic board may be connected to automatic switch contacts, including the common contact, the normally open switch contact and normally close switch contact, and sense this terminal/contact condition and determined the water level.

Electronic Board

According to some embodiments, the electronic board may consist of a processor, a reset switch, a relay, a power converter and LED's for status indication. Depending on the automatic switch contacts status, the processor will sense the contacts, take/make an appropriate decision by tuning the relay On/Off and by turning LEDs On/Off. Two LED's may be used for power and low water control status. For example, a power LED will be turn ON as soon as the switch assembly/device gets initialized. In addition, a low water status LED will be turn ON when the water level is low. The LED will remained ON unless the reset switch is pressed (e.g., by a user, operator, etc.) to meet CSD-1 compliance even if the water level has risen. A dry contact gives flexibility to the installer/user for different power and boiler potentials.

The automatic type switch and electronic board may be packed inside the mechanical enclosure which may be retrofit to existing system low water controllers.

Such a combination has multiple benefits over the mechanical reset switch known in the art, e.g., including one or more of the following:

A. Overcomes manufacturing or assembly issues,
B. Reduces switch cost,
C. Retrofits to existing mechanical low water control s,
D. Provides a power LED indication,
E. Provides a low water status LED indication, and
F. Has dry contacts.

Specific Embodiments

By way of example, and according to some embodiments, the present invention may include, or take the form of, a new and unique switch assembly for controlling a water heating device in a hot water application, including a hot water boiler or furnace. The switch assembly features an electronic circuit board having a signal processor, a reset switch, and a low water status LED for providing a status indication of a low water condition in the water heating device that will remain ON even if the water level has risen unless the reset switch is reset. The signal processor may be coupled to a common contact, a normally closed switch contact and a normally open switch contact of an automatic switch, e.g., like the known type 2 automatic switch. In operation, the signal processor may be configured to:

sense signaling containing information about the status of the normally open switch contact configured to short when the water heating device has sufficient water, and also containing information about the normally closed switch contact configured to short when the water heating device has a low water level, and provide corresponding signaling to turn ON the low water status LED when the water level is low, and respond to a reset switch signal, e.g., provided by the reset switch manual rest by a user/operator, and turn OFF the low water status LED.

The new switch assembly may include one or more of the following features:

The signal processor may be configured to respond to the sensed switching condition of the common contact, the normally closed switch contact and the normally open switch contact, and provide relay control signaling that includes a normally open switch contact control signal and a normally closed switch contact control signal. The electronic circuit board may include a relay configured to respond to the normally open switch contact control signal and provide a normally open burner contact relay signal, and to respond to the normally closed switch contact control signal, and provide a normally closed alarm contact relay signal. This relay control signaling may be provided to control the hot water application, e.g., by turning on/off the boiler or furnace.

The signal processor may also be configured to respond to an initialization of the switch assembly and/or hot water application, and provide a power LED status control signal. The electronic circuit board may include a power LED configured to respond to the power LED status control signal, and turn ON.

The switch assembly may be an E-2M switch assembly, the automatic switch may be a type 2 automatic switch, and the switch assembly may meet CSD-1 compliance.

The reset switch may respond to a user reset command, including pressing a reset button on the reset switch, and provides the reset switch signal, e.g., provided to the signal processor.

According to some embodiments, the switch assembly may include the automatic switch, e.g., such as the type 2 automatic switch. In this embodiment, the present invention may effectively take the form of a switch assembly featuring both an automatic switch in combination with the electronic circuit board. By way of example, and consistent with that set forth herein, the automatic switch may include the common contact and the normally open switch contact configured to short when a boiler has sufficient water, and may also include the common and the normally closed switch contact configured to short when the boiler has a low water level. Moreover, in this embodiment, the electronic circuit board may include the signal processor, the reset switch, and the low water status LED, e.g., consistent with that disclosed herein; and the signal processor may be configured to implement the signal processing functionality consistent with that disclosed herein.

BRIEF DESCRIPTION OF THE DRAWING

The drawing includes the following Figures, not necessarily drawn to scale, including:

FIG. 1 shows a photograph of the current 2M switch connections, including a connection to the boiler, a connection to the alarm, and a connection from a mains supply phase wire, where the neutral wire is not present, as well as a manual reset button/lever.

FIG. 2 shows a system block diagram of the E-2M switch assembly, according to some embodiments of the present invention.

FIG. 3 shows a functionality table setting forth the functionality related to the operation of the E-2M switch assembly.

In the Figures, similar parts are labeled with similar reference numerals. Moreover, not every part is labelled with a reference numeral and lead line in every Figure, so as to reduce clutter in the drawing.

DETAILED DESCRIPTION OF THE INVENTION

Figure 2

FIG. 2 shows a switch assembly generally indicated as 5, e.g., featuring a new and unique combination of an electronic circuit board 10 and an automatic switch 11 (e.g., a type 2 automatic switch). The switch assembly 5 may be used in conjunction with a hot water application 15, that may include a water heating device like a hot water boiler or furnace, as well as a water level sensor or controller. By way of example, the switch assembly 5 may form be a stand-alone component, may form part of the water level sensor, or may form part of a controller component, module, etc. The scope of the invention is not intended to be limited to how the switch assembly 5 and the hot water application 15 are implemented in conjunction with one another. The type 2 automatic switch and its associated functionality are known in the art. The electronic board 10 according to the present invention is backward compatible with the type 2 automatic switch and has the advantage of providing the option to users of converting an automatic LWCO (e.g., using an automatic switch like the type 2 automatic switch) to a CSD-1 complaint LWCO.

By way of example, the electronic circuit board 10 may include a processor or signal processor 14, a reset switch 16, and a low water status LED 18*a* for providing a status indication of a low water condition in the water heating device that will remain ON even if the water level has risen unless the reset switch 16 is reset, e.g., by manually pressing a reset button. The signal processor 14 may be coupled to contacts 11*a*, 11*b*, 11*c* of the automatic switch 11, which include a common (COM) contact labeled 11*c*, a normally open (NO) switch contact labeled 11*b* and a normally closed (NC) switch contact labeled 11*a*.

In operation, the signal processor 14 may be configured to implement the following signal processing functionality:

receive and/or sense signaling along lines 11*a*' and 11*b*' containing information about the status of the normally open (NO) switch contact 11*b* that is configured to short when the water heating device has sufficient water, and also containing information about the normally closed (NC) switch contact 11*a* that is configured to short when the water heating device has a low water level; and provide corresponding signaling along line 14*a* to turn ON the low water status LED 18*a* when the water level is low, and respond to a reset switch signal along line 16*a* and turn OFF the low water status LED.

By way of example, the signal processor 14 may be configured to provide either suitable signaling along line 14*d* and sense if corresponding suitable signaling is received along line 11*a*', or the suitable signaling along line 14*d* and sense if corresponding suitable signaling is received along line 11$b'$, indicating when either switch contact 14$a$, 14$b$ is shorted.

The signal processor 14 may also be configured to respond to the sensed switching condition of the common contact, the normally closed switch contact and normally open switch contact 11$a$, 11$b$, 11$c$, and provide relay control signaling along line 14$b$ to control the relay 20, e.g., causing it to provide a normally open burner contact relay signal along line 20$a$ (aka a no-burner contact signal) and/or a normally closed alarm relay signal along line 20$b$ (aka a nc-burner alarm contact signal). This relay control signaling may be provided along line 14$e$ to control the hot water application 15, e.g., by turning on/off the boiler or furnace.

By way of example, the signal processor 14 may be configured to respond to an initialization of the switching assembly 5, as well as the hot water application as a whole, and provide a power status LED signal along line 14$a'$. The electronic circuit board 10 may include a power LED configured to respond to the power status LED signal, and turn ON to indicate that the power in turned ON.

By way of example, the reset switch 16 may be configured to respond to a user reset command, including pressing a reset button on the reset switch, and provides the reset switch signal, e.g., along line 16$a$ as shown, to the processor 14.

FIG. 2 shows one example for converting an automatic switch (e.g., such as a type 2 automatic switch) into the new E-2M (M-Manual) switch, according to some embodiments of the present invention. (This example disclosed herein is not intended to be restricted to only an E-2M switch, e.g., the scope of the invention is intended to include, and embodiment are envisioned in which, the present invention is implemented to as to form other types or kinds of switches.)

The Processor 14

By way of example, the signal processing functionality of the processor 14 may be implemented using hardware, software, firmware, or a combination thereof. In a typical software implementation, the processor 14 would include one or more microprocessor-based architectures having, e.g., at least one signal processor or microprocessor. One skilled in the art would be able to program such a microcontroller (or microprocessor)-based implementation to perform the functionality described herein without undue experimentation. The scope of the invention is not intended to be limited to any particular implementation using technology either now known or later developed in the future. The scope of the invention is intended to include implementing the functionality of the processor 14 as stand-alone processor or processor module, as separate processor or processor modules, as well as some combination thereof.

The processor 14 may also include other signal processor circuits or components, e.g. including random access memory (RAM) and/or read only memory (ROM), input/output devices and control, and data and address buses connecting the same, and/or at least one input processor and at least one output processor.

The Other Components in the Electronic Board 14

The other components in the electronics board 10 are known in the art, including the manual switch 16, the power converter 19, the LEDs 18$a$, 18$b$ for indicating the power and lower water status, and the relay 20. The scope of the invention is not intended to be limited to any particular type or kind of such components. Moreover, one skilled in the art would be able to implement the underlying functionality without undue experimentation, e.g., consistent with that disclosed herein.

Figure 3

FIG. 3 shows a functionality table setting forth the functionality related to the operation of the E-2M switch assembly.

The functionality table includes rows labeled Functional and CSD compliance.

The functionality table includes columns of testing function(s), e.g., including Power, Water condition, Automatic 2 switch (e.g., including NO contact, NC contact), manual reset button, Relay contacts (e.g., including burner contacts, alarm/feeder contacts), LED status (e.g., including Red LED, Green LED).

The functional row includes two sets of functional conditions for the testing functions, as follows:

- The first set of functional conditions includes: the power (on), the water condition (inwater), the automatic 2 switch—NO contact (short), the automatic 2 switch—NC contact (open), manual reset button (off), the relay contact—burner contacts (close), the relay contacts—alarm/feeder contact (open), LED status—Red LED (DOM of 3 secs and off), and LED status—Green LED (on).
- The second set of functional conditions includes: the power (on), the water condition (outwater), the automatic 2 switch—NO contact (open), the automatic 2 switch—NC contact (short), manual reset button (off), the relay contact—burner contacts (open), the relay contacts—alarm/feeder contact (close), LED status—Red LED (DOM of 5 secs and on), and LED status—Green LED (on).

The CSD compliance row includes three sets of CSD compliance conditions for the testing functions, as follows:

- The first set of CSD compliance conditions includes: the power (off), the water condition (outwater), the automatic 2 switch—NO contact (open), the automatic 2 switch—NC contact (short), manual reset button (off), the relay contact—burner contacts (open), the relay contacts—alarm/feeder contact (close), LED status—Red LED (off), and LED status—Green LED (off).
- The second set of CSD compliance conditions includes: the power (on), the water condition (inwater), the automatic 2 switch—NO contact (short), the automatic 2 switch—NC contact (open), manual reset button (off), the relay contact—burner contacts (open), the relay contacts—alarm/feeder contact (close), LED status—Red LED (on), and LED status—Green LED (on).
- The third set of CSD compliance conditions includes: the power (on), the water condition (inwater), the automatic 2 switch—NO contact (short), the automatic 2 switch—NC contact (open), manual reset button (press and release), the relay contact—burner contacts (close), the relay contacts—alarm/feeder contact (open), LED status—Red LED (DOM of 3 secs and off), and LED status—Green LED (on).

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

What we claim is:

1. A switch assembly for controlling a water heating device in a hot water application, including a hot water boiler or furnace, comprising:

an electronic circuit board having a signal processor, a reset switch, and a low water status LED for providing a status indication of a low water condition in a water heating device that will remain ON even if the water level has risen unless the reset switch is reset, the signal processor being coupled to a common contact, a normally closed switch contact and a normally open switch contact of an automatic switch, the signal processor configured to:

sense signaling containing information about the status of the common contact and the normally open switch contact configured to short when the water heating device has sufficient water, the common contact and the normally closed switch contact configured to short when the water heating device has a low water level, and sense reset switch signaling containing information about a reset switch being manually reset, and provide corresponding signaling to turn OFF the water heating device, and turn ON the low water status LED when the water level is low, and turn ON the water heating device and turn OFF the low water status LED when the water heating device has sufficient water, based upon the signaling sensed.

2. A switch assembly according to claim 1, wherein the signal processor is configured to respond to the sensed switching condition of the common, normally closed and normally open switch contacts, and provide a normally open switch contact control signal and a normally closed switch contact control signal; and the electronic circuit board comprises a relay configured to respond to the normally open switch contact control signal and provide a normally open burner contact relay signal, and to respond to the normally closed switch contact control signal and provide a normally closed alarm contact relay signal.

3. A switch assembly according to claim 1, wherein the signal processor is configured to respond to an initialization of the switch assembly, and provide a power LED status control signal; and the electronic circuit board comprises a power LED configured to respond to the power LED status control signal, and turn ON.

4. A switch assembly according to claim 1, wherein the switch assembly is an E-2M switch assembly, the automatic switch is a type 2 automatic switch, and the switch assembly meets CSD-1 compliance.

5. A switch assembly according to claim 1, wherein the reset switch responds to a user reset command, including pressing a reset button on the reset switch, and provides the reset switch signaling.

6. A switch assembly according to claim 1, wherein the switch assembly comprises the automatic switch.

7. A switch assembly for controlling a water heating device in a hot water application, including a hot water boiler or furnace, comprising:

an automatic switch having a common contact and a normally open switch contact configured to short when a water heating device has sufficient water, and having the common contact and a normally closed switch contact configured to short when the water heating device has a low water level; and an electronic circuit board having a signal processor, a reset switch, and a low water status LED for providing a status indication of a low water condition of the water heating device that will remain ON even if the water level has risen unless the reset switch is reset, the signal processor being coupled to the common contact, the normally closed switch contact and the normally open switch contact, the signal processor also configured to:

sense signaling containing information about the status of the common contact, the normally closed switch contact and the normally open switch contact, sense reset switch signaling containing information about a reset switch being manually reset, and provide corresponding signaling to turn OFF the water heating device and turn ON the low water status LED when the water level is low, and turn ON the water heating device and turn OFF the low water status LED, based upon the signaling sensed.

8. A switch assembly according to claim 7, wherein the signal processor is configured to respond to the sensed switching condition of the common contact, the normally closed switch contact and the normally open switch contact, and provide a normally open switch contact control signal and a normally closed switch contact control signal; and the electronic circuit board comprises a relay configured to respond to the normally open switch contact control signal and provide a normally open burner contact relay signal, and to respond to the normally closed switch contact control signal and provide a normally closed alarm contact relay signal.

9. A switch assembly according to claim 7, wherein the signal processor is configured to respond to an initialization of the apparatus, and provide a power LED status control signal; and the electronic circuit board comprises a power LED configured to respond to the power LED status control signal, and turn ON.

10. A switch assembly according to claim 7, wherein the switch assembly is an E-2M switch assembly, the automatic switch is a type 2 automatic switch, and the switch assembly meets CSD-1 compliance.

11. A switch assembly according to claim 7, wherein the reset switch responds to a user reset command, including pressing a reset button on the reset switch, and provides the reset switch signaling.

* * * * *